US011787227B2

(12) United States Patent
Wang et al.

(10) Patent No.: US 11,787,227 B2
(45) Date of Patent: Oct. 17, 2023

(54) COMPACT TOOL COMBINING VACUUM/BLOWER, PENCIL SHARPENER, RUBBERY ERASER, AND STORAGE SPACE

(71) Applicants: Cary Wang, New Canaan, CT (US); Chun Wang, New Canaan, CT (US)

(72) Inventors: Cary Wang, New Canaan, CT (US); Chun Wang, New Canaan, CT (US)

( * ) Notice: Subject to any disclaimer, the term of this patent is extended or adjusted under 35 U.S.C. 154(b) by 382 days.

(21) Appl. No.: 16/833,553

(22) Filed: Mar. 28, 2020

(65) Prior Publication Data

US 2020/0331287 A1 Oct. 22, 2020

Related U.S. Application Data

(60) Provisional application No. 62/828,534, filed on Apr. 3, 2019.

(51) Int. Cl.
*B43L 23/08* (2006.01)
*A47L 7/00* (2006.01)
(Continued)

(52) U.S. Cl.
CPC ..... *B43L 23/08* (2013.01); *A45C 11/34* (2013.01); *A45C 15/00* (2013.01); *A47L 7/00* (2013.01);
(Continued)

(58) Field of Classification Search
None
See application file for complete search history.

(56) References Cited

U.S. PATENT DOCUMENTS 1,965,765 A * 7/1934 Ell ..... A47L 7/04 15/257.1
2,408,767 A * 10/1946 Fleming ..... B43L 23/02 144/28.5
(Continued)

FOREIGN PATENT DOCUMENTS

CN 105946416 A * 9/2016
CN 213676165 U * 7/2021
KR 20150001938 U * 5/2015

OTHER PUBLICATIONS

Pkeoh Vacuum Cleaner,Children'S Electric Pencil Sharpener, Auto-Stop and With Vacuum Cleaner Function, Pencil Sharpeners with Desk Vacuum, Can Be Used in School, 2022, Walmart: (Year: 2022).*
(Continued)

*Primary Examiner* — Brian D Keller
*Assistant Examiner* — Dana Lee Poon
(74) *Attorney, Agent, or Firm* — ST. ONGE STEWARD JOHNSTON & REENS LLC

(57) ABSTRACT

A handheld device of compact size combining a mini electric vacuum/blower, a pencil sharpener, a rubbery eraser, and a storage unit. The inventive device has one or more containers that house a motor and rotary fan for the vacuum/blower, a battery that powers the vacuum/blower, a pencil sharpener, a rubbery eraser, and a storage unit. The vacuum is used to clean the crumbs from the rubbery eraser or other small objects on a surface, and the vacuum easily converts to a blower that will generate air steam. The storage unit can house certain sized school supplies such as crayons, pens, pencils, or other small items. The inventive of the device is compact enough so that it can be operated single handedly and it can be carried in pockets or small bags.

8 Claims, 3 Drawing Sheets

(51) Int. Cl.

| | |
|---|---|
| ***A45C 15/00*** | (2006.01) |
| ***A45C 11/34*** | (2006.01) |
| ***B25F 5/02*** | (2006.01) |
| ***B25F 1/00*** | (2006.01) |

(52) U.S. Cl.
CPC ..... *B25F 1/00* (2013.01); *B25F 5/02* (2013.01); *B25F 5/029* (2013.01)

(56) References Cited

U.S. PATENT DOCUMENTS 4,554,700 A * 11/1985 Lyman ..... A47L 9/0027 15/327.2
4,955,105 A * 9/1990 Sunagawa ..... A47L 9/0027 15/327.5
5,247,719 A * 9/1993 Wareham ..... A47L 9/0036 15/351
6,021,891 A * 2/2000 Anderson ..... A45C 11/34 206/214
7,231,686 B1 * 6/2007 Matheney ..... A47L 7/009 15/313
7,510,225 B1 * 3/2009 Stinnett ..... A01D 9/00 294/51
7,513,007 B2 * 4/2009 Chernoff ..... A47L 5/24 62/331
9,962,921 B1 * 5/2018 Lyon ..... G05B 19/4099
2001/0016989 A1 * 8/2001 Luttgens ..... B43L 23/00 30/453
2002/0170935 A1 * 11/2002 Annis ..... A61M 1/06 224/655
2003/0208874 A1 * 11/2003 Steffen ..... A47L 5/362 15/323
2008/0245829 A1 * 10/2008 Hansen ..... A45C 7/0054 224/153
2010/0088843 A1 * 4/2010 Reed ..... H01M 50/209 320/112
2010/0139032 A1 * 6/2010 Tomasiak ..... A47L 7/0042 29/402.01

OTHER PUBLICATIONS

"321 PoW1, "Miniature Henry Desk Vacuum" (Jul. 21, 2015), Youtube" (Year: 2015).*
"Paladone Store, "Henry & Hetty Desktop Henry Vacuum Cleaner", (Oct. 24, 2015), Amazon" (Year: 2015).*

* cited by examiner

COMPACT TOOL COMBINING VACUUM/BLOWER, PENCIL SHARPENER, RUBBERY ERASER, AND STORAGE SPACE

CROSS-REFERENCE TO RELATED APPLICATIONS

This application claims the benefit of provisional patent application No. 62/828,534, filed on Apr. 3, 2019 by the present inventors.

FIELD OF THE INVENTION

The present invention relates to the field of handheld writing instruments and in particular, a compact tool combining a writing implement, a vacuum/blower, a pencil sharpener, an eraser and a storage space.

BACKGROUND OF THE INVENTION

Even with the development of computer based learning, many schools around the world, especially elementary and middle schools, still require students to bring handwriting supplies to work in classrooms, as handwriting is one of the most essential skills for younger students. Typical supplies related to handwriting include writing instruments such as pencils and pens, erasers, pencil sharpeners, etc.

Commonly these supplies can be acquired separately and they are usually stored in a pencil box or a pouch. However, occasionally some of the items are misplaced or lost.

The present invention relates generally to a combination of pencil sharpening, mark erasing, vacuuming/blowing, and storage. More specifically the device fits all of the above in a compact size that can be carried in pocket or small bags and it can be operated with just one hand. It eliminates the needs to buy and carry the above items separately.

Rubbery eraser is a great tool to remove unwanted marks on paper or other surface written by pencils. However, a common complaint is about the crumbs from the erasers. Not only do they result in untidy working environment, but also they tend to stick to the surface and become difficult to remove. One of the most effective ways to remove eraser crumbs is vacuuming or blowing. The vacuum/blow function from the present invention can help create and maintain a clean working environment.

There are numerous patents related to suction devices, pencil sharpening, and other related apparatus.

LG Electronics Inc. (U.S. Ser. No. 10/582,821) describes a cleaner of simple structure that includes a suction motor and sufficient air passage width that generates suction force, a dust separation unit, a motor housing, and flow guide.

Hilti Aktiengesellschaft (U.S. Ser. No. 09/656,361) describes a dust removal system handheld power tool that includes fan, a suction hose, and a collecting container, and a filter with consecutive fins that are slanted to reduce the adhesion of the dust to the fin.

John Lee Love (U.S. Pat. No. 594,114) patent describes a simple, light-weight, crank-powered pencil sharpener that catches the shavings While these devices may be suitable for the particular purpose they address, none of the above is suitable for providing a single apparatus that combines the function of pencil sharpener, eraser, vacuum/blower, and storage.

Further, the present invention can be constructed in a compact size for anyone including youth to carry and operate easily. In these respects, the present invention substantially departs from the conventional concept and design of the prior arts, and in so providing an apparatus primarily developed for the purpose of eliminating the need to acquire and carry each device separately.

SUMMARY OF THE INVENTION

In view of the foregoing disadvantages inherent in the known types of supplies related to handwriting and cleaning now present in the prior arts, the present invention provides a new design to combine multiple functions in a compact size.

A primary object of the present invention is to provide a combination of functions including but not limited to: erasing unwanted surface pencil marks, vacuuming/blowing crumbs/small objects, sharpening pencils, and storing small items.

Another object is to provide a compact size tool that can be carried and operated with ease.

An additional object is to provide a tool that keeps the working environment clean by vacuuming/blowing the crumbs from the erasing or other small objects.

Another object of the invention is to save time by eliminating the need to purchase each item separately.

A further object is to reduce the likelihood of misplacing each item.

An additional object is to provide personalizing options with decorative exterior designs such as shape, color, labels, etc.

The main body of the device can advantageously be manufactured in a 3D printer.

Another advantage of the invention is that a cost of the unit can be less expensive than purchasing each item separately.

Yet another advantage is an option to power the vacuum through batteries or USB charging.

To the accomplishment of the above and related objects, this invention may be embodied in the form illustrated in the accompanying drawings and pictures. However, the drawing and pictures are for illustrative purpose only, and changes may be made in the specific construction illustrated and described within the scope of the appended claims.

BRIEF DESCRIPTION OF THE DRAWINGS

Various features and advantages of the present inventions will become fully appreciated in conjunction with the accompanying drawings.

DRAWINGS REFERENCE NUMERALS/LETTERS

Figure 1:
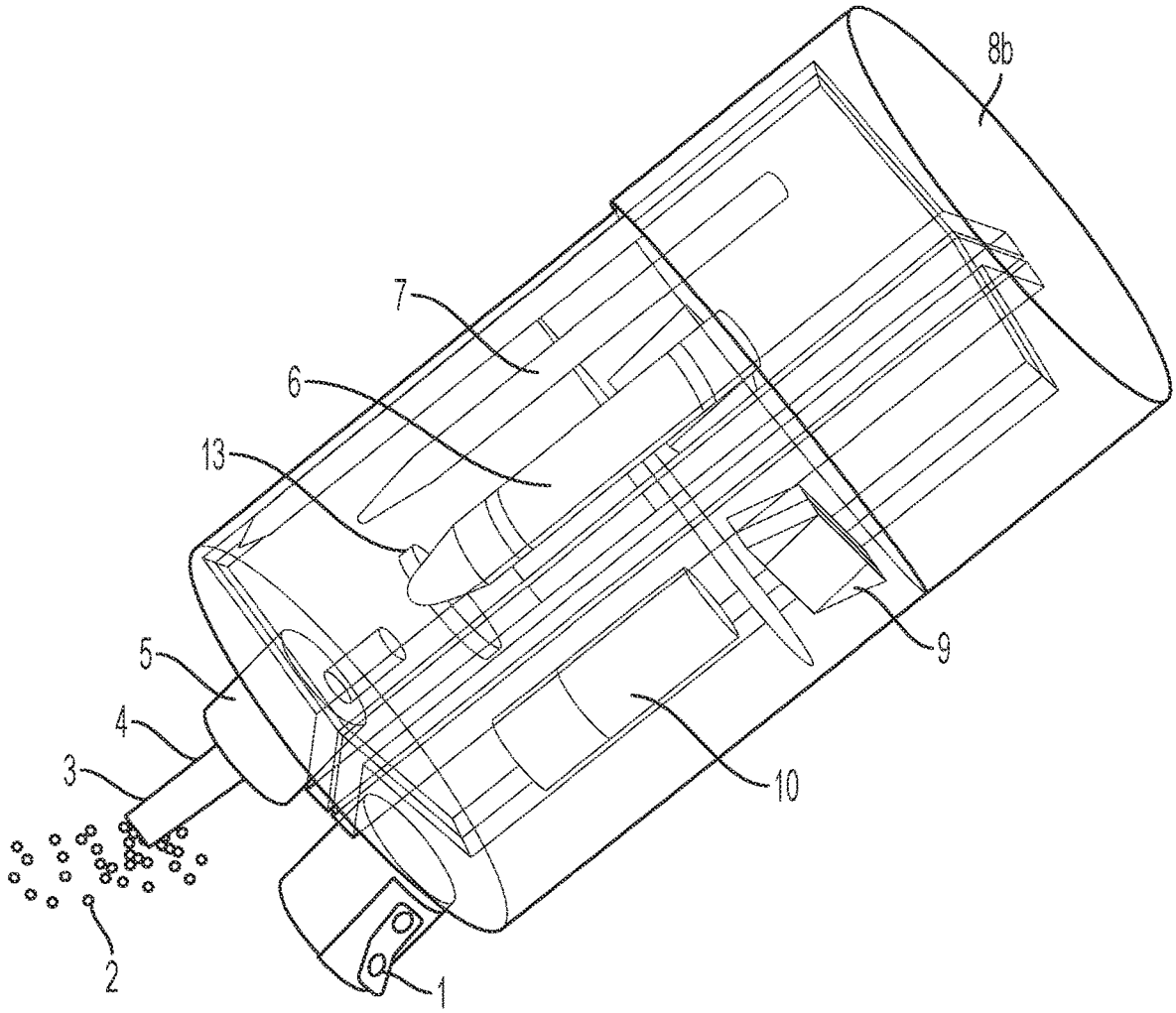
FIG. 1 illustrates the operational view when the apparatus is used to vacuum or blow small objects when the cap is removed from one end.

1 Electric switch
2 Small objects such as crumbs from rubbery eraser
3 Hose
4 Foldable joint
5 Screw-on cap
6 Writing instrument such as crayon
7 Writing instrument such as pencil
8 a Removable cap from one end
8*b* Removable cap from the other end

9 Rubbery eraser
10 Battery
11 Pencil sharpener
12 Motor
13 Rotary fan
14 Cylinder shape of one of the containers

DETAILED DESCRIPTION OF THE INVENTION

Turning now descriptively to the drawings:

FIG. 1 illustrates an operational view when the inventive device is used to vacuum or blow small objects 2 such as crumbs from the rubbery eraser 9. The air stream flows through the hose 3 that can be folded at the joint 4. The switch 1 can shift the rotary fan 13 between sucking in air and pushing air through the hose 3 into a compressed air stream. FIG. 1 also shows an internal view of the container that houses the battery 10 and rubbery eraser 9, and an additional container that functions as a storage space for school suppliers such as pencils 7 or crayons 6.

Figure 2A:
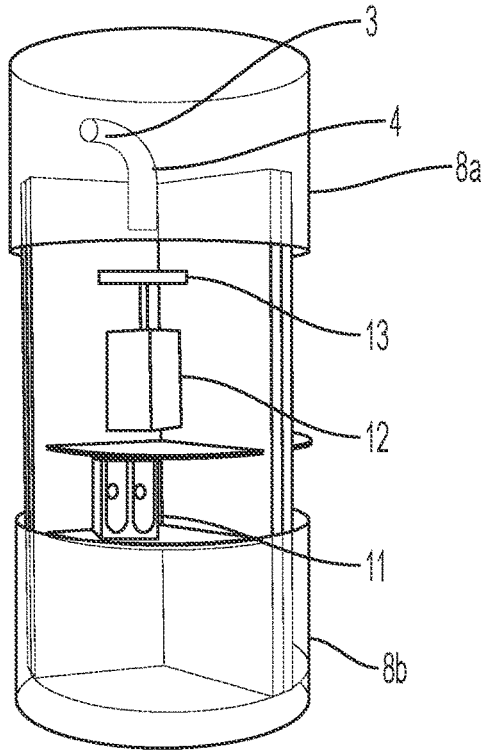
FIG. 2A to FIG. 2C illustrate the side view of each container.

FIG. 2A illustrates the side view of the container that houses the pencil sharpener 11, the motor 12 and the rotary fan 13. When the apparatus is not in use, caps 8*a* and 8*b* inserted at both ends of the device can be closed to safely house the internal components.

Figure 2B:
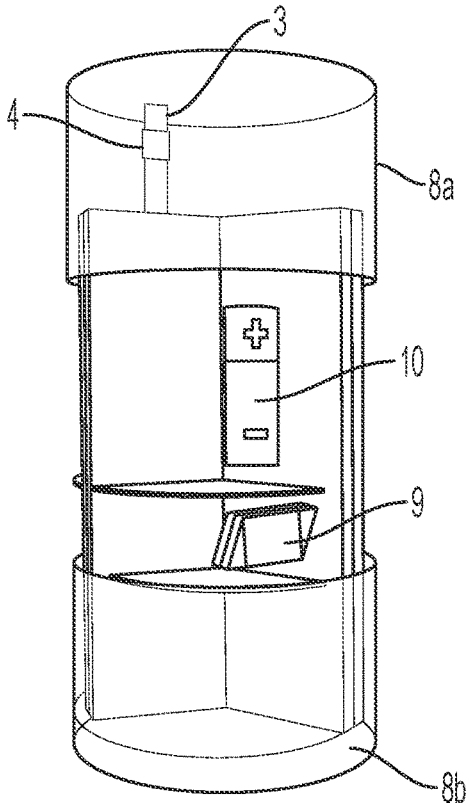

FIG. 2B illustrates the side view of the container that houses the battery 10 and rubbery eraser 9. The battery 10 can be either rechargeable or non-rechargeable. The curved side of the container can be opened when the battery 10 is to be removed or recharged. The wires that connect the battery 10 to the motor 12 and switch 1 are not shown here.

Figure 2C:
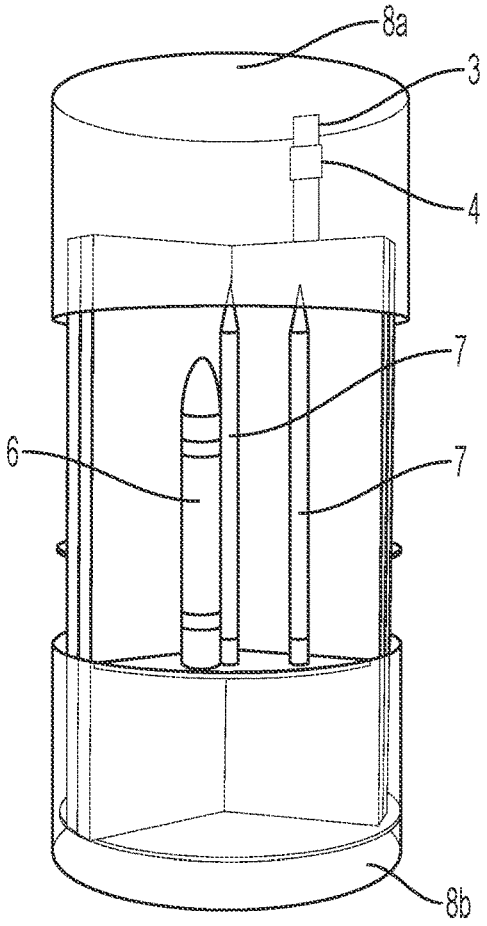

FIG. 2C illustrates the side view of the container that functions as a storage unit that a user can place small items into such as short pencils 7 or crayons 6. These items can be retrieved by opening either cap 8*a* or cap 8*b* from one end.

Figure 3:
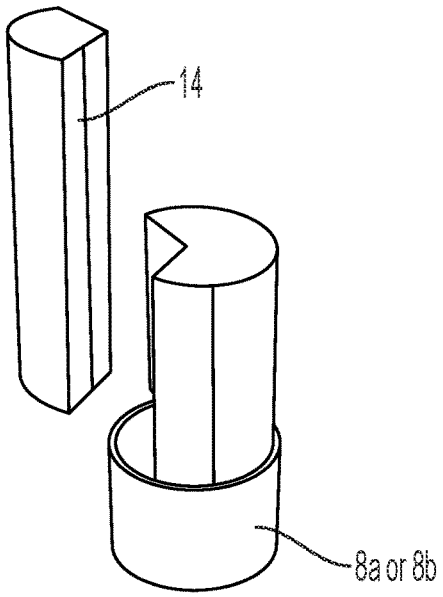
FIG. 3 illustrates the cylinder structure of the apparatus and individual container.

FIG. 3 illustrates the cylinder shape 14 of the internal containers and how each container fits well with one another.

In use, when the cap 8*a* is opened from one end, the user will see the vacuum/blower hose attached to a screw-on cap 5, the switch 1 to turn on/off the vacuum/blower, and the closed bottom of the storage container, as shown in FIG. 1.

When the cap 8*b* is opened from the other end, the user will see the pencil sharpener 11 fixed to the inner sider of the container, a chamber for the rubbery eraser 9, and screw-on cap (not shown) of the storage unit.

With respect to the above descriptions, they may contain certain specificities. However, it is to be realized that they should not be construed as limiting the scope of embodiments, but as merely providing illustrations of the principle of the invention. The optimum construction of the invention may include variation in size, material, shape, assembly, function and manner of operation whichever are deemed obvious to one skilled in art.

Since numerous modifications and changes will readily occur to those skilled in art, it is not desired to limit the invention to the exact construction and operation shown and described, and accordingly the scope of the embodiments should be determined by the claims in this application and their legal equivalent, rather than by the examples shown above.

We claim:

1. A handheld apparatus comprising:

a housing having an outer wall of a cylindrical shape with a longitudinal axis, wherein the housing is configured to be carried by a user in a pocket or a bag, and a plurality of containers accommodated within the housing, wherein at least one of a pencil sharpener, a rubbery eraser, and a writing utensil is disposed in at least one of the plurality of containers, and at least one removable cap that covers at least one of a first end of the housing and a second end of the housing;

wherein the handheld apparatus comprises a vacuum and a blower positioned in one of the plurality of containers, and wherein the vacuum and the blower comprise a hose coupled to the housing and configured to fold or retract to fit inside the housing without having to be disconnected from the housing to allow the at least one removable cap to close;

wherein air is pushed out of the hose by the blower and is sucked in through the hose by the vacuum.

2. The handheld apparatus of claim 1, wherein each of the plurality of containers is shaped such that the plurality of containers fit together to correspond to the substantially cylindrical shape of the housing when accommodated inside the housing.

3. The handheld apparatus of claim 1, wherein the at least one removable cap comprises a first removable cap and a second removable cap, wherein the first removable cap covers at least the first end of the housing perpendicular to the longitudinal axis and the second removable cap covers at least the second end of the housing opposite the first end.

4. The handheld apparatus of claim 1, wherein the vacuum and the blower comprise a battery accommodated in one of the plurality of containers.

5. The handheld apparatus of claim 4, wherein the battery is selected from a rechargeable battery and a non-rechargeable battery.

6. The handheld apparatus of claim 1, wherein the vacuum and the blower comprise a motor and a fan housed in one of the plurality of containers, wherein said container has a removable cap for ease of emptying objects collected via the vacuum.

7. The handheld apparatus of claim 1, wherein the plurality of containers comprise a storage container configured to store at least one item, wherein the storage container has a removable screw-on cap.

8. The handheld apparatus of claim 1, wherein the housing and the plurality of containers are printed with a 3D printer.

* * * * *